United States Patent [19]

Tanaka et al.

[11] Patent Number: 5,022,138

[45] Date of Patent: Jun. 11, 1991

[54] FLAT CABLE TERMINATING APPARATUS

[75] Inventors: Hiromi Tanaka, Machida; Tadashi Osaka, Kanagawa, both of Japan

[73] Assignee: AMP Incorporated, Harrisburg, Pa.

[21] Appl. No.: 461,520

[22] Filed: Jan. 5, 1990

[30] Foreign Application Priority Data

Jun. 2, 1988 [JP] Japan ..... 63-136003

[51] Int. Cl.[5] ..... H01R 43/04

[52] U.S. Cl. ..... 29/564.8; 29/753

[58] Field of Search ..... 29/564, 564.2, 564.7, 29/564.8, 749, 755, 759, 857, 861, 566.3, 566.1

[56] References Cited

U.S. PATENT DOCUMENTS 3,875,662 4/1975 Folk ..... 29/753

4,275,495 6/1981 Boutcher, Jr. et al. ..... 29/753

4,476,905 10/1984 Maben ..... 29/749

4,765,044 8/1988 Wilson et al. ..... 29/564.4

4,860,447 8/1989 Nicholas et al. ..... 29/753

*Primary Examiner*—William Briggs

*Attorney, Agent, or Firm*—Allan B. Osborne; Adrian J. LaRue

[57] ABSTRACT

An apparatus for preparing an end of a flat electrical cable for connection to electrical contacts of a connector is disclosed. The apparatus includes a clamp (10) having a movable section (12) for clamping the cable, a positioning device (100) for positioning the clamp section (12) in response to a sensing member (102), conductor aligning comb members (250) and a cutting and bending device (270) for cutting and bending the conductors (1) of the cable.

6 Claims, 7 Drawing Sheets

FLAT CABLE TERMINATING APPARATUS

The present invention relates to an apparatus for preparing a flat electrical cable by accurately aligning and arranging electrical conductors of the cable for electrical connection to electrical contacts of an electrical connector.

Conventional electrical connectors are used to electrically connect and disconnect electrical circuits. The connectors are of the type that have signal and ground contacts which are electrically connected to signal and ground conductors of flat transmission cables thereby forming cable assemblies that are widely used.

In order to electrically connect the signal and ground conductors of the flat transmission cable to the signal and ground contacts of the connector, the cable must be prepared so that the signal and ground conductors are in position to effect the electrical connections with the signal and ground contacts. The diameters of the conductors are very small and they are spaced closely together. Technicians using microscopes manually prepared the cables by positioning and bending the conductors for connection to the signal and ground contacts of the connectors. This resulted in low production and conductor positioning tended to be uneven. The reliability of the connector was therefore effected by these factors.

It is an object of the present to provide an apparatus that overcomes the above drawbacks and accurately aligns conductors of a flat cable and arranges them for electrical connection to electrical contacts of an electrical connector.

An apparatus for preparing an end of a flat electrical cable for aligning, cutting and bending electrical conductors of the cable for electrical connection to electrical contacts of an electrical connector comprises a clamp including a base, a movable clamping section in which the flat cable is to be mounted is positioned on the base, and a locking section for locking the clamping section in position on the base; a clamp-positioning device including a sensing member for sensing a first conductor of exposed conductors of the cable between a jacket and a front end jacket, a lock release device for releasing the locking section, and a clamp-moving device is operated if the first conductor is not in alignment with the sensing member to move the clamping section along the base after the locking section has been released by the lock release device until the first conductor is in alignment with the sensing member whereafter the lock release device permits the locking section to lock the clamping section on the base; and a conductor-aligning, cutting and bending device including a conductor-aligning device for clamping onto the front end jacket, a conductor-detecting device for detecting the first conductor, the conductor-aligning device being operated if the first conductor is out of alignment with the conductor-detecting device to move the front end jacket until the first conductor is detected by the conductor-detecting device, comb members having teeth, a comb-moving device for moving the comb members so that the conductors are positioned between the teeth thereby spacing and aligning the conductors, and a conductor-cutting and bending device for cutting the conductors and bending them.

The invention, together with objects and advantages thereof, is best understood by way of example with reference to the following detailed description in conjunction with the accompanying drawings.

Figure 12:
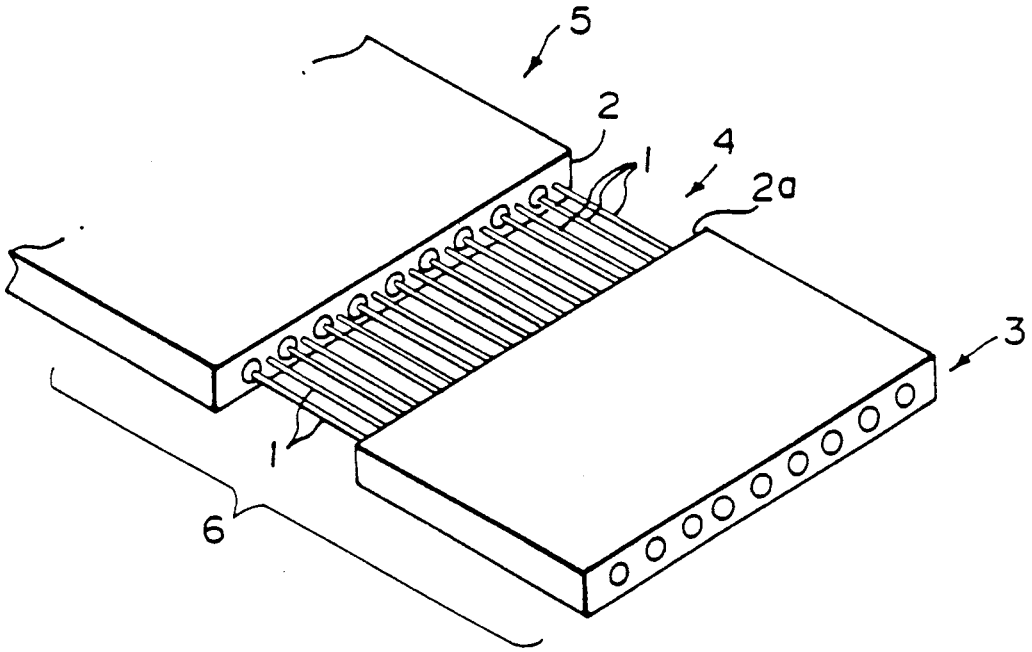
FIG. 12 is a part perspective view showing a partly stripped end of a flat electrical cable before being processed to align, cut and bend the conductors.

As shown in FIG. 12, a front end 3 of flat electrical cable 5 has a section 4 of insulation jacket 2 stripped exposing horizontally-aligned electrical conductors 1 extending between jacket 2 and jacket 2*a* that has been left on the ends of the conductors.

Figure 13:
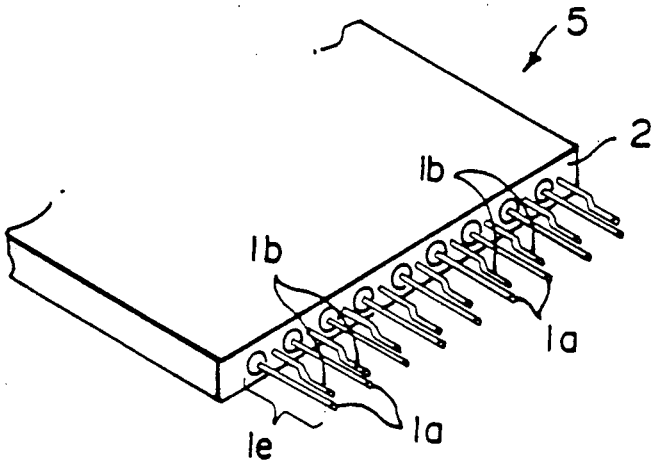
FIG. 13 is a view similar to FIG. 12 showing the prepared end of the cable with the conductors being aligned, cut and bent for electrical connection to the connector contacts.

FIG. 13 shows the prepared end of cable 5 after the conductors have been spaced and bent by the apparatus of the present invention so that they can be electrically connected to electrical contacts of an electrical connector. Conductors 1 include signal conductors 1*a* in a plane and ground conductors 1*b* with outer sections being bent and disposed in another plane parallel to the plane of the signal conductors 1*a* while the inner sections of the ground conductor 1are in the same plane of the signal conductors 1*a*.

Figure 1A:
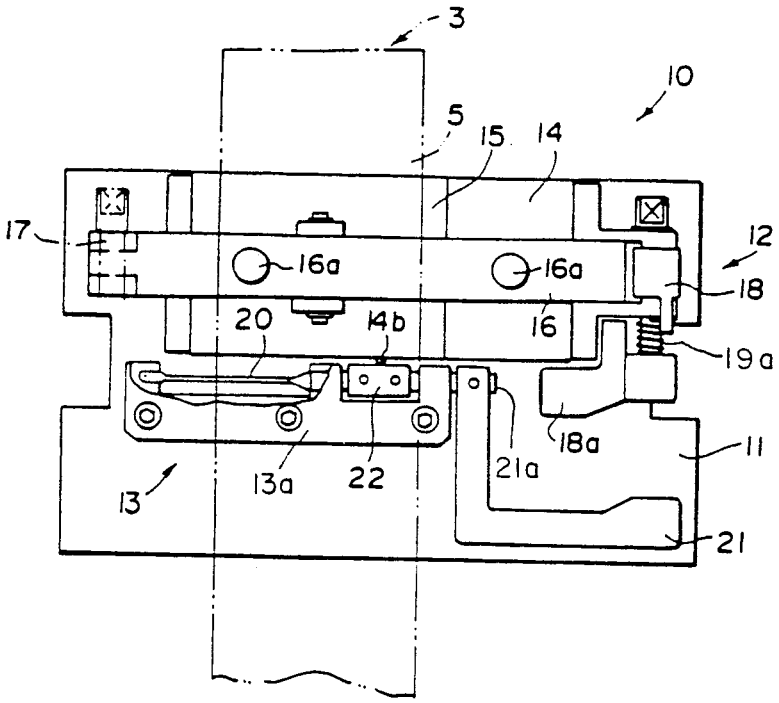
FIGS. 1A–1C are respectively a top plan view, a front elevational view and a side view showing a cable clamp for a flat electrical cable.
Figure 1C:
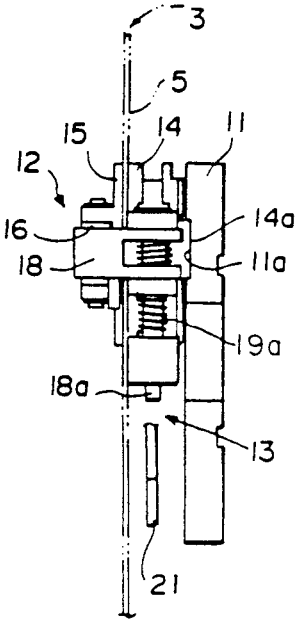
Figure 1B:
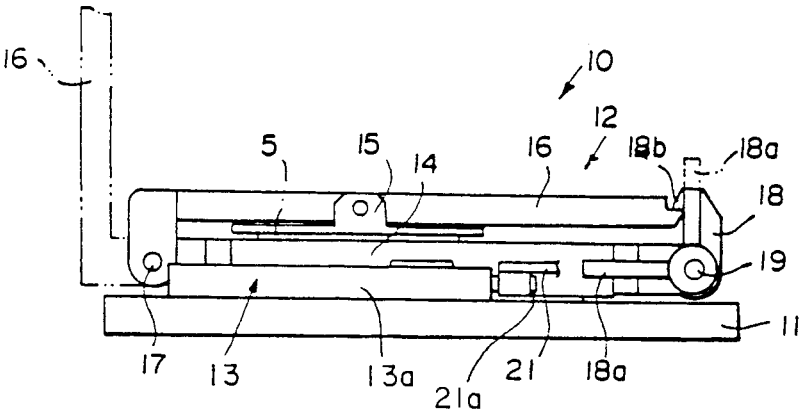

Cable clamp 10 is shown in FIGS. 1A–1C and includes a base 11, cable-clamping section 12 mounted on base 11 and a locking section 13. Cable-clamping section 12 has a lower plate 14 and upper plate 15 between which flat cable 5 is clamped.

Upper plate 15 is pivotally mounted onto lever 16 which is pivotally on lower plate 14 via pin 17 enabling it to move between an open position and a latched position, as shown in FIG. 1B. Spaced holes 16*a* are located in an upper surface of lever 16.

Figure 2:
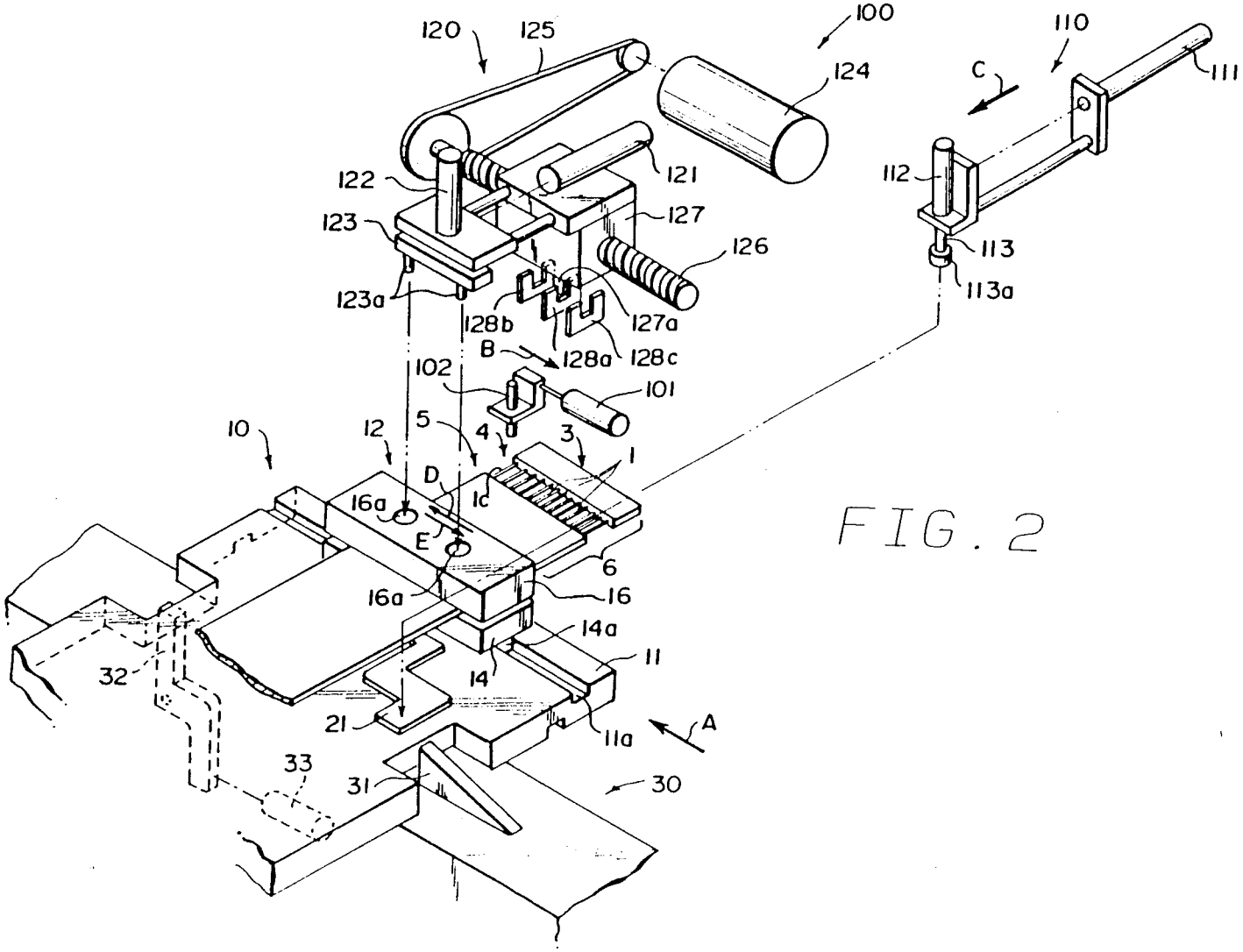
FIG. 2 is an exploded perspective view of a clamp-positioning device for positioning the cable clamp to which a stripped flat cable is clamped so that the cable conductors will be positioned for electrical connection to the contacts of an electrical connector.

A latch member 18 latches lever 16 in a latched position, as shown in FIG. 1B, and is pivotally mounted by pin 19 to lower plate 14 so that it can stay in a latched position by a spring 19*a* biasing hook 18*b* into engagement with the free end of lever 16. The outer surface of hook 18*b* is tapered and so is the front surface of the free end of lever 16 which when engaging one another moves latch member 18 against the bias of spring 19*a* causing hook 18*b* to latchably engage the free end of lever 16 when these tapered surfaces clear one another so that spring 19*a* biases hook 18*b* onto lever 16 thereby latching it in its latched position. This clamps cable 5 between plates 14, 15 with section 6 including stripped section 4 of cable 5, as shown in FIG. 2, extending forwardly of clamping section 12. Arm 18*a* is secured to pin 19 and is movable in a clockwise direction to move hook 18*a* free of the free end of lever 16 against the bias of spring 19*a* to unlatch lever 16 to position cable 5 in clamp 10 and remove it therefrom.

Projection 14*a* extends outwardly from the bottom surface of plate 14 and is disposed in channel 11*a* of base 11 enabling clamping section 12 to move back-and-forth along base 11. Projection 14*b* extends outwardly from a rear surface of plate 14 for engagement by locking device 13 to maintain clamp 12 in position on base 11.

Locking section 13 includes a plate 13*a* that is mounted on base 11. An L-shaped lever 21 is secured to one end of a shaft 21*a* that is rotatably mounted in plate 13*a*. The other end of shaft 21*a* is connected to one end of a torsion spring 20 which has its other end mounted to plate 13*a*. An engaging member 22 is secured onto shaft 21*a* within a slot of plate 13*a* and pressingly engages projection 14*b* in its normal position to maintain clamping section 12 at a selected position. To release member 22 from projection 14*b*, a downward force is applied to the free end of lever 21 causing shaft 21*a* to move in a counter-clockwise direction against the torsional spring force of spring 20 which moves member 22 upwardly free of projection 14*b* thereby enabling clamping section 12 to move in the directions of arrows D, E along base 11, as shown in FIG. 2.

Cable clamp 10 with the stripped end 6 of cable 5 clamped therein, is engaged by a pawl 31 of a conveying device 30 which moves in the direction of arrow A thereby moving clamp 10 and cable 5 to the clamp-positioning station at which the clamp and cable are stopped by an arm of a pivotally-mounted lever 32 and at which a clamp-positioning device 100 is located, as shown in FIG. 2. Cylinder 101 is operated causing a light-sensing member 102 to move in the direction of arrow B until it detects the first conductor 1*c* of exposed conductors 1. If cable 5 has been correctly positioned in clamping section 12 and clamping section 12 is correctly positioned along base 11 as detected by sensing member 102, no adjustment of the clamping section 12 is necessary because conductors 1 are correctly positioned for termination to the respective termination sections of the electrical connector. This being the case, cylinder 33 is operated causing the shaft connected to the piston thereof to move which pivots lever 32 freeing clamp 10 enabling pawl 31 and conveying device 30 to move the clamp 10 and stripped cable 5 to the conductor-aligning, cutting and bending device 200 of FIG. 3 which will be described later on.

If conductor 1*c* has not been detected by sensing member 102 after cylinder 101 has moved sensing member 102 to its selected position, cylinder 111 of lock release device 110 is operated thereby moving cylinder 112 and rod 113 in the direction of arrow C until end 113*a* of rod 113 is aligned with lever 21 of locking section 13. Cylinder 112 is operated moving rod 113 downwardly causing end 113*a* to engage lever 21 and push it downwardly freeing engaging member 22 of locking section 13 from projection 14*b* enabling clamping section 12 and cable 5 to be moved along base 11 in the directions of arrows D, E.

Cylinder 121 of clamp-moving device 120 is operated thereby moving cylinder 122 and plate 123 outwardly from block 127 along parallel rods until plate 123 overlies lever 16 of clamping section 12. Cylinder 122 is operated moving plate 123 downwardly whereby pins 123*a* are inserted into holes 16*a* of lever 16 of clamping section 12. Pins 123*a* are smaller in diameter than holes 16*a* so that accurate positioning is unnecessary.

Reversible electric motor 124 is operated to drive a pulley and belt drive 125 thereby rotating drive screw 126 that engages threads in block 127 to drive it back and forth along drive screw 126 in accordance with the direction of operation of motor 124.

First, second and third microswitches 128*a, b, c* are positioned between sensing member 102 and block 127 with switch 128*a* in the center and aligned with the position of sensing member 102 when it is moved by cylinder 101 to its conductor 1*c* sensing position. A projection 127*a* extends downwardly from the bottom surface of block 127 and activates switches 128*a, b, c*. These switches can be light-sensing devices, if desired.

If conductor 1*c* is to the left of switch 128*a* and motor 124 is driving block 127 towards switch 128*b* thereby driving clamping section 12 and cable 5 in the direction of arrow D, projection 127 will operate switch 128*b* when it arrives at switch 128*b* thereby reversing the operation of motor 124 causing drive screw 126 to drive block 127 and clamping section 12 and cable 5 in the direction of arrow E until projection 127*a* engages and operates switch 128*a* thereby stopping motor 124 and any further movement of block 127 and clamping section 12 and conductor 1*c* is aligned with sensing member 102.

If conductor 1*c* is to the right of switch 128*a*, the cable-moving device 120 operates opposite to that described above by driving clamping section 12 and cable 5 in the direction of arrow E until switch 128*c* is operated whereupon clamping section 12 and cable 5 are driven in the direction of arrow D until switch 128*a* is operated thereby stopping motor 124.

At this position, cylinders 122, 121, 112 and 111 are operated releasing cable-moving device 120 from clamping section 12 and lock release device 110 from lever 21 which causes engaging member 22 to engage projection 14*b* thereby maintaining clamping section 12 and cable 5 at this position on base 11. Cylinder 33 is operated moving lever 32 free of clamp 10 so that pawl 31 and conveying device 30 can move clamp 10 and aligned cable to conductor-aligning, cutting and bending device 200 of FIG. 3.

Figure 3:
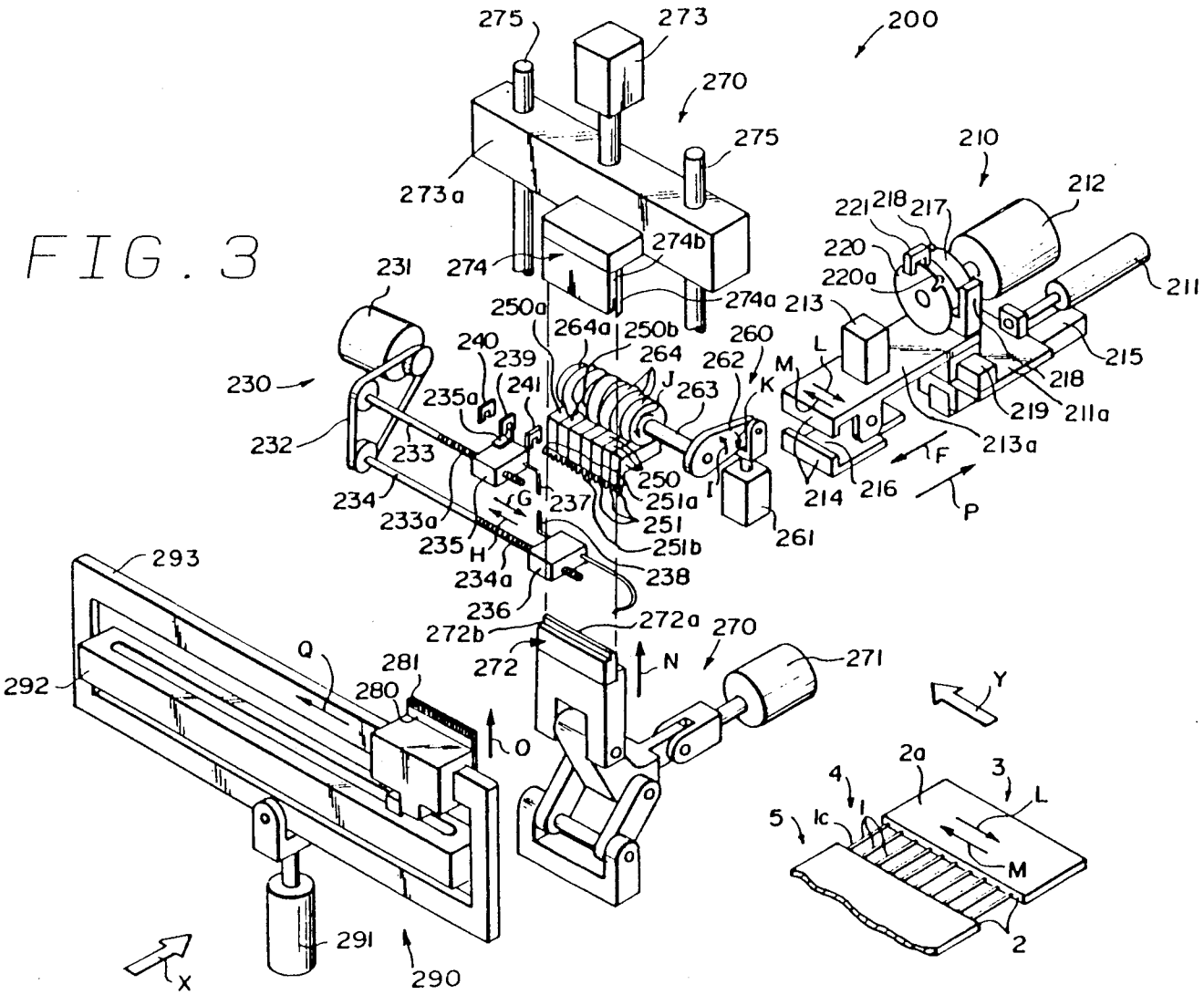
FIG. 3 is an exploded perspective view of a conductor-aligning, cutting and bending device for aligning, cutting and bending the cable conductors for electrical connection to the connector contacts.

As shown in FIG. 3, cable 5 is moved via clamp 10 and conveying device 30 (both of which has been omitted from FIG. 3 so as not to include subject matter already disclosed and deemed unnecessary) to a stop position such as pivoted lever 32 of FIG. 2. Cylinder 211 is operated of conductor-aligning device 210 thereby moving plate 211*a* on which electric motor 212, cylinder 213, plate 213*a*, clamping members 214 and rail 219 are mounted along rail 215 in the direction of arrow F until jacket 2*a* of cable 5 is positioned in opening 216 between clamping members 214. Cylinder 213 is operated causing its shaft to engage the bottom clamping member 214 that is pivotally mounted to the upper clamping member 214 thereby clamping insulation jacket 2*a* between clamping members 214, as shown in FIGS. 5B and 8–10.

Reversible electric motor 231 of conductor detection device 230 is operated to drive screws 233, 234 via a belt 232 engaging pulleys on the motor shaft and drive screws 233, 234. Threads 233*a*, 234*a* of drive screws 233, 234 threadably engage threads in blocks 235, 236. Thus, when motor 231 operates, blocks 235, 236 move in the directions of arrows G, H in accordance with the rotational direction of operation of motor 231.

Light-transmitting member 237 is mounted on block 235 whereas light-receiving member 238 is spaced from and in alignment with light-transmitting member 237 and is mounted on block 236. Members 237, 238 form a detecting device to detect the presence of conductors 1 of cable 5. Projection 235*a* is located on an upper surface of block 235 and activates central microswitch 239 and microswitches 240, 241 spaced to the left and right of switch 239. Switches 239, 240, 241 in conjunction with projection 235*a* detect the position of members 237, 238 as they move in the directions of arrows G, H.

FIGS. 4–11 in conjunction with FIG. 3 show the operations involved to adjust the conductor spacings of cable 5 and to bend certain conductors so that the conductors are in proper position for termination to the termination sections of electrical contacts of an electrical connector.

Figure 4:
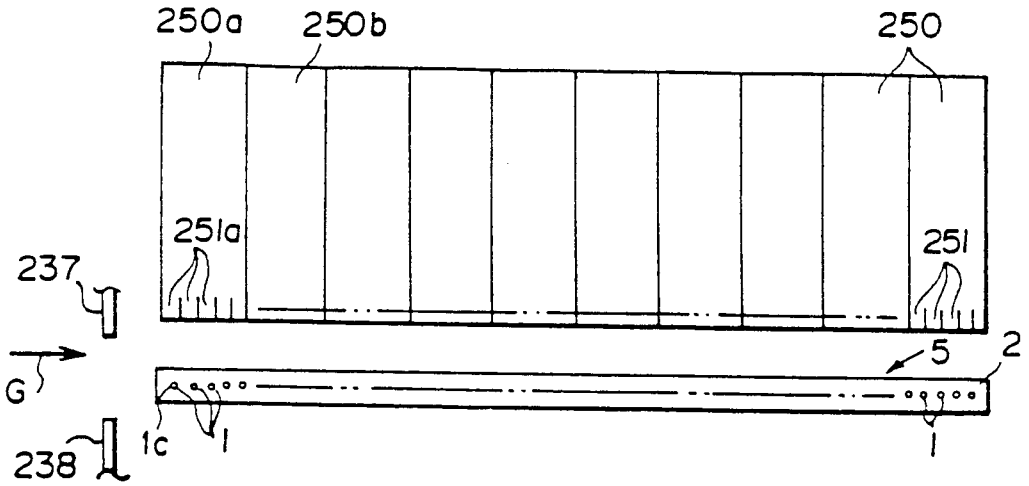
FIGS. 4–11 are diagramatic views showing the essential components of the device of FIG. 3 for aligning, cutting and bending the cable conductors.

FIG. 4 is a front elevational view of multiple comb members 250, electrical conductors 1 of cable 5 and light-transmitting member 237 and light-receiving member 238 which are seen from the direction of arrow X of FIG. 3. In FIG. 4, five conductors 1 starting with conductor 1*c* are a single unit and the first conductor of each unit are detected by the detecting device 237, 238 and comb members 250*a*, 250*b* . . . 250*n* are associated with each unit of five conductors of cable 5 to accurately position them if they are misaligned.

Figure 5A:
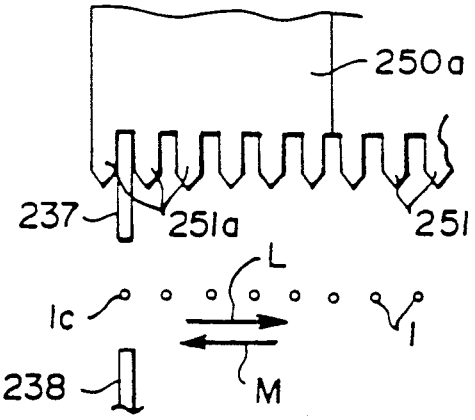
Figure 5B:
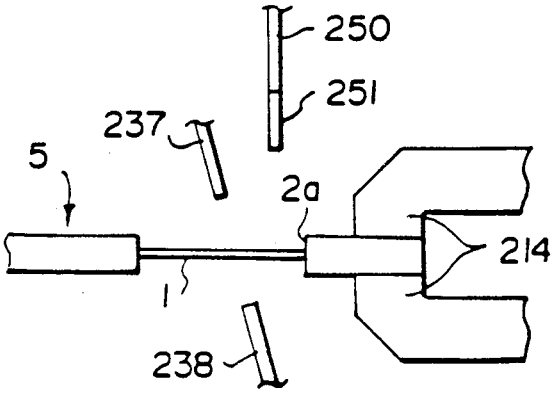

Motor 231 operates thereby moving detecting device 237, 238 in the direction of arrow G. If conductor 1*c* is in its correct position corresponding to switch 239, detecting device 237, 238 is stopped. FIGS. 5A, 5B are views looking in the directions of arrows X and y of FIG. 3 showing the front and side views of comb members 250, detecting device 237, 238 detecting conductor 1*c*, conductors 1, cable 5 and clamping members 214 clamped onto jacket 2*a*.

Figure 6:
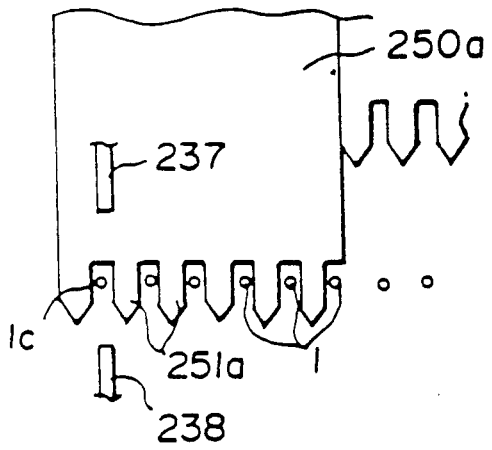

When conductor 1*c* has been detected by detecting device 237, 238, as indicated in FIG. 5A, cylinder 261 of the comb drive device 260 is operated thereby moving link 262 in the direction of arrow 1, as shown in FIG. 3, whereby rod 263 is moved causing cam 264*a* to move about 30 degrees in the direction of arrow J. Cam 264*a* moves comb member 250*a* downward so that conductors 1 are received between teeth 251*a* at the bottom of comb member 250*a*, as shown in FIG. 6. Cylinder 261, link 262 and rod 263 return to their original positions by movement of link 262 in the direction of arrow K. Teeth 251*a* uniformly space the five conductors of this unit.

If conductor 1*c* is not at its correct position so that detecting device 237, 238 does not detect it, then conductor 1*c* is adjusted in the following manner. Motor 212 is operated thereby rotating eccentric cam 217 which is mounted on the shaft of motor 212. Cam 217 engages one of the legs of a U-shaped member 218, which is secured to a plate 213*a* on which cylinder 213 and clamping members 214 are mounted, thereby moving plate 213*a* along track 219 in the directions of arrows L or M. This also moves jacket 2*a* and the front end of cable 5 in the same direction thereby moving conductor 1*c* and the other conductors of this unit until conductor 1*c* is detected by the detecting device 237, 238 and motor 212 stops. Comb member 250*a* is then moved downward so that the conductors of this unit are positioned between teeth 251*a* as described above.

In order to operate motor 212 so that plate 213*a* moves in the direction of arrow L or M, a disc 220 is mounted on the shaft of motor 212 and the position of notch 220*a* of disc 220 detected by photoelectric device 221 will determine which direction motor 212 will operate to move the front end of cable 5 so that conductor 1*c* is detected by the detecting device 237, 238.

Figure 7:
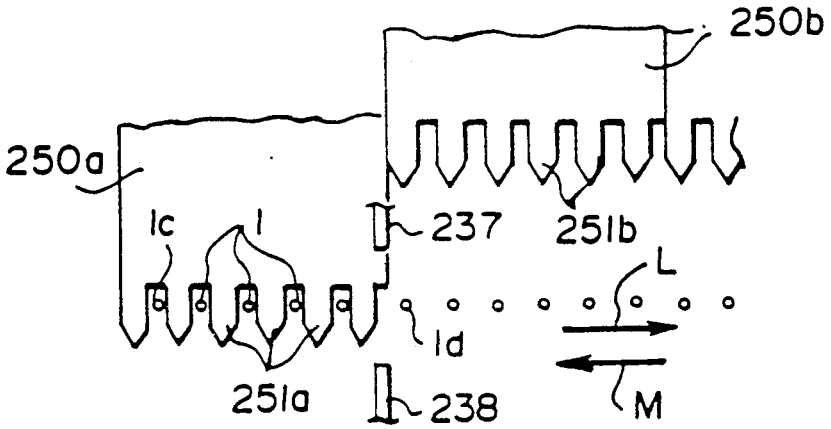

Motor 231 then operates to move the detecting device 237, 238 to detect the next first conduct 1*d* of the next unit of five conductors, as shown in FIG. 7. If conductor 1*d* is correctly positioned, comb member 250*b* is operated as heretofore described so that these conductors are positioned between teeth 251*b* of comb member 250*b*. If, on the other hand, conductor 1*d* is incorrectly positioned, then the front end of cable 5 is moved in the direction of arrows L or M, as heretofore described whereafter the conductors are positioned between the teeth 251*b* of comb member 250*b*.

Figure 8:
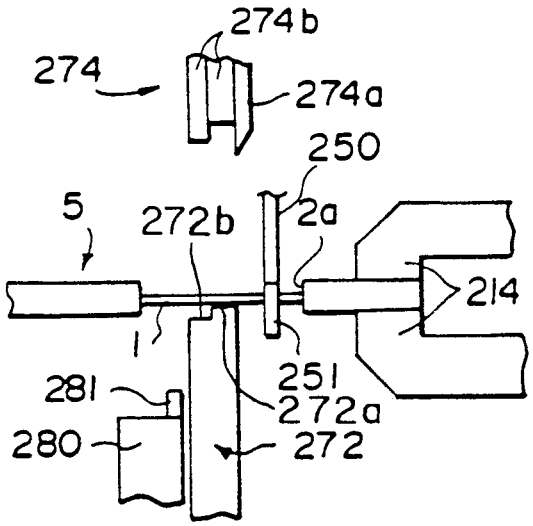
Figure 9:
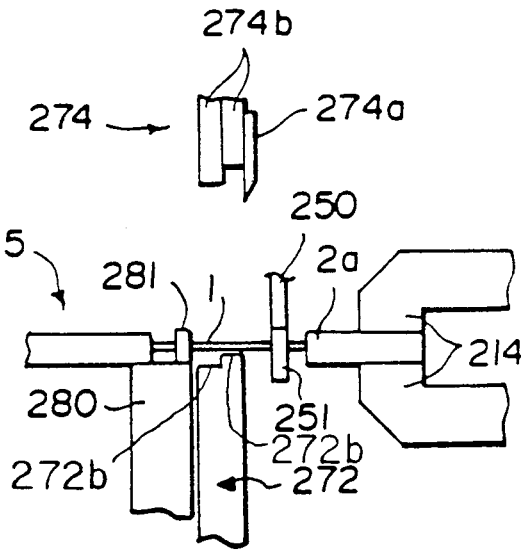

The other units of conductors are processed in like manner until all the conductors are positioned between the teeth 251 of the comb members 250 which are maintained in their down positions by cams 264. Cylinder 271 of conductor-cutting and bending device 270, as shown in FIG. 3, is operated and the upper surface 272*a* of member 272 is raised in the direction of arrow N until surface 272*a* engages conductors 1, as shown in FIG. 8. Cylinder 291 of comb drive device 290, as shown in FIG. 3, is operated thereby moving lower comb member 280 upwardly in the direction of arrow 0 so that conductors 1 are positioned between teeth 281 of comb member 280; the teeth 281 being the same number of teeth 251 of comb members 250 so that conductors 1 are supported between comb members 250 and comb member 280 and the spacings are maintained therebetween on each side of member 272, as shown in FIG. 9.

Figure 10:
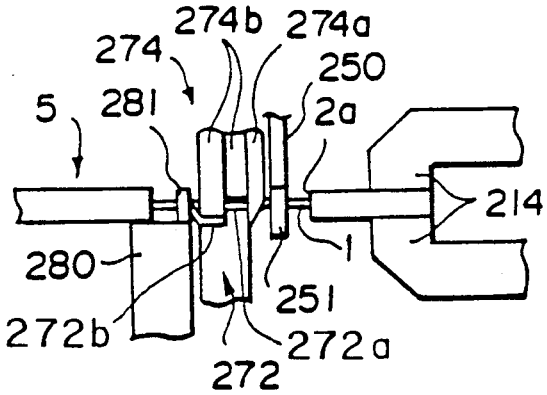
Figure 11:
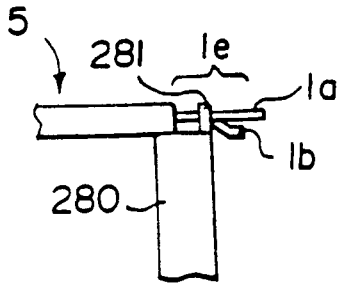

Cylinder 273 of conductor-cutting and bending device 270, as shown in FIG. 3, is next operated and block 273*a* to which upper member 274 is mounted is moved downwardly while being guided along spaced parallel rods 275. Conductor-bending and cutting-member 274 includes cutting member 274*a* which along with an edge of upper surface 272*a* cuts conductors 1 and bending member 274*b* which has teeth that engage and bend the front ends 1*e* of conductors 1*b* into engagement with lower surface 272*b*, as shown in FIGS. 10, 11 and 13.

Cylinder 213 is operated opening clamping members 214; motor 212 operates returning eccentric cam 217 and plate 213*a* to its original position on rail 219; cylinder 211 is operated moving plate 211*a* along rail 215 to its original position in the direction of arrow P; cylinder 261 is operated thereby moving comb members 250 to their original positions; cylinders 271 and 273 are operated lowering comb member 272 and raising cutting and bending member 274; and motor 231 is operated moving sensing device 237, 238 to its original position. Comb member 280 remains in its operated position, as shown in FIG. 11, so that the conductors 1 are maintained in position and is then moved along frame 293 in the direction of arrow Q via member 292, as shown in FIG. 3, thereby moving cable 5 to the next station at which the conductors 1*a*, 1*b* are welded to respective electrical contacts of an electrical connector(not shown) by a conventional welding device. Comb member 280 is then moved downwardly by operation of cylinder 291 and returned to its original position via member 292 or comb member 280 can be moved along frame 293 to another downstream station for further operations on the cable and connector assembly via member 292 to maintain the conductors in proper spaced relationship.

The above-described operations of the cable-preparing apparatus are automatically, continuously and rapidly repeated to accurately adjust and bend conductors of flat cables for termination to electrical contacts of electrical connectors thereby forming reliable electrical cable assemblies at a rapid rate.

We claim:

1. An apparatus for preparing an end of a flat electrical cable for aligning, cutting and bending electrical conductors of the cable for electrical connection to electrical contacts of an electrical connector, characterized in that:

a clamp (10) including a base (11), a movable clamping section (12) in which the flat cable (5) is to be mounted is positioned on the base (11), and a locking section (13) for locking the clamping section (12) in position on the base (11);

a clamp-positioning device (100) including a sensing member (102) for sensing a first conductor (1*c*) of exposed conductors (1) of the cable (5) between a jacket (2) and front end jacket (2*a*), a lock release device (110) for releasing the locking section (13), and a clamp-moving device (120) which is operated if the first conductor (1*c*) is not in alignment with said sensing member (102) to move the clamping section (12) along the base (11) after the locking section (13) has been released by said lock release device (110) until the first conductor (1*c*) is in alignment with said sensing member (102) whereafter the lock release device (110) permits the locking section (13) to lock the clamping section (12) on the base (11); and a conductor-aligning, cutting and bending device (200) including a conductor-aligning device (210) for clamping onto the front end jacket (2*a*), a conductor-detecting device (230) for detecting the first conductor (1*c*), said conductor-aligning device (210) being operated if the first conductor (1*c*) is out of alignment with said conductor-detecting device (230) to move the front end jacket (2*a*) until the first conductor (1*c*) is detected by the conductor-detecting device (230), a comb member (250) having teeth (251), a comb-moving device (260) for moving the comb members (250) so that the conductors (1) are positioned between the teeth (251) thereby spacing and aligning the conductors (1), and a conductor-cutting and bending device (270) for cutting the conductors (1) and bending the conductors (1*b*).

2. An apparatus as claimed in claim 1, characterized in that said base (11) has a channel (11*a*) in which a projection (14*a*) on the clamping section (12) is disposed.

3. An apparatus as claimed in claim 1, characterize din that said locking section (13) includes a spring-biased engaging member (22) and a lever (21) connected thereto for moving said engaging member (22) out of engagement with a projection (14*a*) on said clamping section (12) when said lever (21) is engaged by said lock release device (110).

4. An apparatus as claimed in claim 1, characterized in that said clamp-moving device (120) comprises a block (127) having a projection (127*a*), a driving screw (126) threadably engages with said block (127) to drive said block back and forth, first, second and third microswitches (128*a, b, c*) respectively positioned for engagement by said projection (127*a*) with said first microswitch (128*a*) being located at a central position in alignment with said sensing member (102) and second and third microswitches (128*b, c*) respectively being spaced to each side of said first microswitch (128*a*), a plate (123) having spaced pins (123*a*) movably mounted onto said block (127) and being moved so that said pins (123*a*) are within holes (16*a*) of clamping section (12) so that said driving screw (126) drives said block (127) and said clamping section (12) and the cable 5 clamped therein from said second microswitch (128*b*) or third microswitch (128*c*) after said lock release device (110) has released the locking section (13) until said projection (127*a*) operates said first microswitch (128*a*) whereby the first conductor (1*c*) is aligned with said sensing member (102) whereafter said lock release device (110) permit the locking section (13) to lock the clamping section (12) on the base (11).

5. An apparatus as claimed in claim 1, characterized in that the comb member (250) comprises a plurality of comb members (250*a*, 250*b*) and said comb-moving device (260) includes cam members (264) corresponding to the same number of said comb members (250*a*, 250*b*) for moving the comb members (250*a*, 250*b*) so that the conductors (1) are positioned between the teeth (251).

6. An apparatus as claimed in claim 1, characterized in that said conductor-cutting and bending device (270) comprises a member (272) having an upper surface (272*a*) that is positioned against the conductors (1) and another comb member (280) that is positioned so that its teeth (281) receive the conductors (1) therebetween, a conductor-bending and cutting member (274) having a cutting member (274*a*) that in conjunction with an edge of said upper surface (272*a*) of said member (272) cuts the conductors (1) and a bending member (274*b*) has teeth that engage and bend certain ones (1*b*) of conductors (1) into engagement with a lower surface (272*b*) of member (272).

* * * * *

UNITED STATES PATENT AND TRADEMARK OFFICE

CERTIFICATE OF CORRECTION

PATENT NO. : 5,022,138

DATED : June 11, 1991

INVENTOR(S) : Hiromi Tanaka, et al.

It is certified that error appears in the above-indentified patent and that said Letters Patent is hereby corrected as shown below:

In claim 3, column 7, line 47, add a --d-- to "characterize" and in line 48, the word "din" should be --in--.

In claim 4, column 8, line 26, add an --s-- to the word "permit"

Signed and Sealed this

Twenty-eighth Day of September, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,022,138

DATED : JUNE 11, 1991

INVENTOR(S) : HIROMI TANAKA, TADASHI OSAKA

It is certified that error appears in the above-identified patent and that said Letters Patent is hereby corrected as shown below:

In column 1, line 3, after the title, please add the following: -- This is a continuation of International Application PCT/US89/02199 filed May 22, 1989, which designated the United States and is now abandoned.--

Signed and Sealed this

Twenty-eighth Day of June, 1994

*Attest:*

Bruce Lehman

BRUCE LEHMAN

*Attesting Officer*

*Commissioner of Patents and Trademarks*